US010768651B1

(12) United States Patent
Hagen

(10) Patent No.: US 10,768,651 B1
(45) Date of Patent: Sep. 8, 2020

(54) SHUNT CURRENT REGULATOR FOR DOWNHOLE DEVICES

(71) Applicant: HALLIBURTON ENERGY SERVICES, INC., Houston, TX (US)

(72) Inventor: Trond Hagen, Sandefjord (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/457,718

(22) Filed: Jun. 28, 2019

(51) Int. Cl.
*G05F 1/575* (2006.01)
*E21B 17/00* (2006.01)
*E21B 47/00* (2012.01)

(52) U.S. Cl.
CPC ..... *G05F 1/575* (2013.01); *E21B 17/003* (2013.01); *E21B 47/00* (2013.01)

(58) Field of Classification Search
CPC . G05F 1/56; G05F 1/563; G05F 1/565; G05F 1/575; G05F 1/577; G05F 1/59; E21B 17/003; E21B 17/023; E21B 17/026; E21B 47/00
See application file for complete search history.

(56) References Cited

U.S. PATENT DOCUMENTS 3,986,393 A * 10/1976 Hawley ..... E21B 47/06 73/152.52
5,959,547 A 9/1999 Tubel et al.
5,960,883 A 10/1999 Tubel et al.
6,252,518 B1 6/2001 Laborde
6,300,750 B1 10/2001 Oglesbee et al.
6,369,718 B1 4/2002 Mathieu
7,139,218 B2 11/2006 Hall et al.
7,525,264 B2 * 4/2009 Dodge ..... H02P 1/54 318/108
7,649,474 B1 * 1/2010 Gard ..... E21B 47/122 340/854.3
8,330,612 B2 12/2012 O'neill et al.
(Continued)

FOREIGN PATENT DOCUMENTS

CN 103580104 2/2018
EP 0493579 B 2/1992
WO 2014127489 8/2014

OTHER PUBLICATIONS

U.S. Appl. No. 16/457,456 , "Non-Final Office Action", dated Mar. 5, 2020, 15 pages.
(Continued)

*Primary Examiner* — Matthew V Nguyen
(74) *Attorney, Agent, or Firm* — Kilpatrick Townsend & Stockton LLP

(57) ABSTRACT

A shunt current regulator can be used to maintain current levels at downhole device on a tubing encapsulated cable and improve communication speed between the surface and downhole devices. The shunt current regulator reduces the current noise on the tubing encapsulated cable allowing for higher bitrate transfer. In some aspects, a sensing element monitors the current drawn and generates a sense signal. In other aspects, a compensation signal is generated from the sense signal. The compensation signal may be used as input to control a transistor to regulate the current drawn from the tubing encapsulated cable. The transistor can dissipate power to stabilize the current drawn or provide compensation current to increase the current drawn.

20 Claims, 7 Drawing Sheets

(56) References Cited

U.S. PATENT DOCUMENTS

| | | | | |
|---|---|---|---|---|
| 8,330,615 | B2 | 12/2012 | Hagen | |
| 8,339,276 | B2 * | 12/2012 | Mandal | G01V 11/002 340/853.3 |
| 8,353,336 | B2 | 1/2013 | Neuhaus et al. | |
| 8,857,507 | B2 | 10/2014 | Freeman | |
| 9,683,438 | B2 | 6/2017 | Fanini et al. | |
| 2008/0196887 | A1 | 8/2008 | McCoy et al. | |
| 2008/0272932 | A1 | 11/2008 | Booker et al. | |
| 2010/0117854 | A1 | 5/2010 | Hagen | |
| 2012/0268288 | A1 | 10/2012 | Cousin et al. | |
| 2013/0106615 | A1 | 5/2013 | Prammer | |
| 2013/0307700 | A1 | 11/2013 | Hassan et al. | |
| 2014/0292530 | A1 | 10/2014 | Weerasinghe et al. | |
| 2015/0061390 | A1 | 3/2015 | Zhang et al. | |
| 2016/0084076 | A1 | 3/2016 | Fanini et al. | |

OTHER PUBLICATIONS

PCT/US2019/039954 , "International Search Report and Written Opinion", dated Mar. 27, 2020, 14 pages.
PCT/US2019/039995 , "International Search Report and Written Opinion", dated Mar. 31, 2020, 12 pages.

* cited by examiner

SHUNT CURRENT REGULATOR FOR DOWNHOLE DEVICES

TECHNICAL FIELD

The present disclosure relates generally to devices used in hydrocarbon extraction. More particularly, the present disclosure relates to regulating current in an all-electric completion for downhole devices.

BACKGROUND

In drilling or operating wells for hydrocarbon extraction, understanding the structure and properties of the associated geological formation provides information to aid in drilling and operating the well more efficiently. The physical conditions inside the wellbore can be monitored to ensure proper operation of the well. A wellbore is a challenging environment, with temperatures that can approach 150 degrees C. (302 degrees F.), 175 degrees C. (347 degrees F.), or even 200 degrees C. (392 degrees F.), and pressures that can approach 25 kpsi (172 MPa, or about 1700 atmospheres), or even 30 kpsi (207 MPa, or about 2000 atmospheres). There is ongoing effort to develop systems and methods that can allow for more flexibility in making measurements and collecting data downhole, without significant loss of precision in systems and techniques to communicate efficiently downhole at a well site.

DETAILED DESCRIPTION

Figure 1:
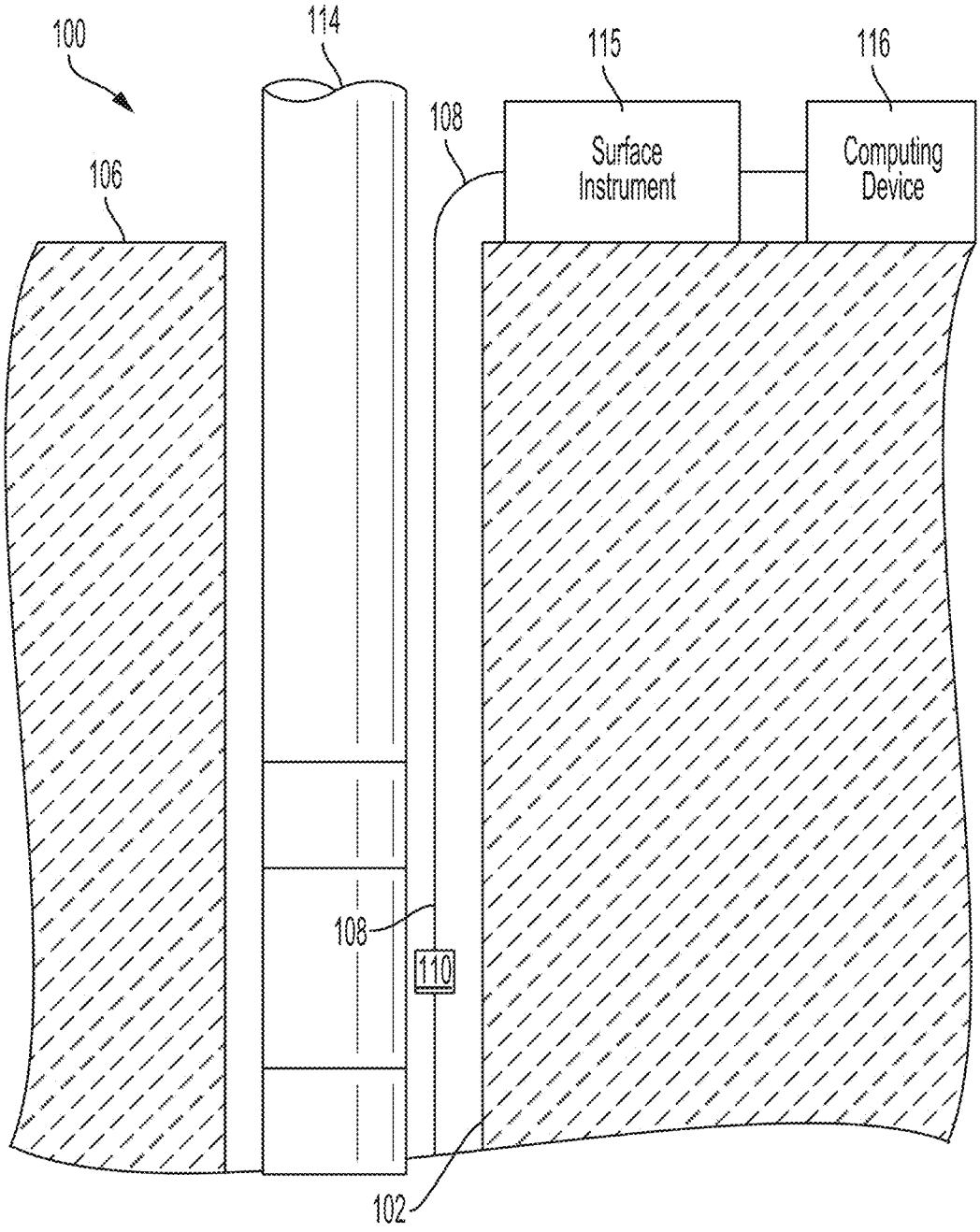
FIG. 1 is a schematic view of a well that includes a system for making measurements in a wellbore according to some aspects of the disclosure.

Certain aspects and features relate to a shunt current regulator for improving communication bitrate on a tubing encapsulated cable by maintaining approximately a constant current level and reducing noise in a downhole environment. Certain aspects and features provide an active noise canceller or current stabilizer to make a tubing encapsulated cable (cable) load on a downhole network system constant during operation of noisy downhole devices. Examples of noisy downhole devices include actuators and inductive couplers. For example, the operations of an inductive coupler may include antenna current chopping. Other devices may include high current with time variant current levels. Certain aspects and features of this disclosure stabilize the current consumption by actively, and in some examples dynamically, increasing current up to a level where all noise and current variations are cancelled. The result is a substantially steady (but, on average, higher) current consumption than the peak current consumption required by the downhole device.

As the downhole industry moves to reduce or eliminate hydraulic actuators in favor of electrically operated actuators, the industry needs a more complex downhole electric network system with many sensors and actuators on one electrical line or cable, e.g., a cable line. Increasing the proportion of electrical sensors introduces noise on the power and communication channel represented by the single cable line. Aspects and features provide for higher communication data rates and a more reliable and less noisy communication environment is provided.

Well systems face challenges with communication speed from instruments or actuators to surface control or computing systems. The communication speed can be slowed by noise caused by variations in the downhole load currents. Inductive couplers in particular are being used in downhole applications in more and more situations where wireless or contactless connections are needed. Inductive couplers connected to a cable tend to introduce noise onto the cable. This noise makes communication on the cable by equipment connected to the cable more difficult and can even prevents communication on the cable. This is particularly the case if the inductive coupler is driven by a square-wave signal. Sinusoidal driving signals for the inductive couplers would be kinder in terms of noise, but the driver transistors would then be operating more in the linear operating region, resulting in higher power dissipation and higher junction temperatures, leading to reduced reliability. Therefore, square-waves are often used.

Well systems also face challenges of controlling current variations when using inductive couplers for power transfer. When input power is supplied via a long cable, large capacitors are needed at the inductive coupler for stabilizing current while antennas are switching. If the antennas were purely resistive, the current drawn from the cable would be steady at all times, with just a small glitch when switching. However, the antennas are usually highly inductive, so that the current required from the cable will vary significantly over time. The variations in current can cause reverse currents that will influence the voltage stability of the cable and capacitors may be used to prevent reverse current. Capacitors are not very reliable over the long term in the downhole environment. Capacitors have the disadvantage of being unreliable at high temperatures. Depending on the design, the capacitors may also attenuate the communication signal when signaling on the same cable as the power is transferred. Accordingly, a circuit that reduces the current variation while eliminating the need for capacitors is advantageous.

In one aspect, control of an electrical current along a cable allows greater stability of the network. Maintaining the current within the cable approximately constant reduces a noise caused by current fluctuations on the cable. The current on the cable may be controlled by including a shunt current regulator couplable to the cable. The shunt current regulator reduces fluctuation of the current on the cable by counter-balancing the fluctuations of a downhole load. For example, if a downhole load decreases the current drawn from the cable, the shunt current regulator may increase its current drawn from the cable to maintain the overall current drawn at a stable level (e.g., total current may be the downhole loads added to the shunt current regulator and inherent electrical losses). Particularly in a system that implements power line communication (PLC), the use of a shunt current regulator can improve the communication throughput by maintaining a stable cable current. In some examples, the cable current can be maintained at approximately 100% stable when a shunt current regulator is implemented.

Certain aspects and features provide methods of current regulation. In some examples, the current regulation involves monitoring the current drawn from a cable disposed in a downhole system. In some aspects, a sensing element monitors the current drawn and generates a sense signal. In other aspects, a compensation signal is generated from the sense signal. The compensation signal may be used as input to control a transistor to regulate the current drawn from the cable. The transistor can dissipate power to stabilize the current drawn or provide compensation current to increase the current drawn.

In one example, a cable is disposed in a downhole environment that connects to a surface computing system and various downhole circuits. An apparatus connected to the cable can include a switch mode voltage regulator that may be connected to the cable and a downhole circuit. The downhole circuit may include a shunt current regulator and a current load in a parallel circuit. In some configurations, the current load includes both high-current loads and low-current loads.

Certain aspects and features of this disclosure provide for faster and more reliable communications downhole. Certain aspects and features can enhance reliability of and reduce the size of inductive couplers or other variable current devices (e.g., motors, actuators, etc.) by eliminating the need for high value capacitors and otherwise allow the use of less complex circuitry both uphole and downhole. Certain aspects and features reduce the need to shut down inductive couplers during communication, or to cease communication during active use of any downhole device that tends to create noise on the cable.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 schematically illustrates an example well that includes a system for making measurements in a wellbore according to some aspects. System 100 illustrates multiple alternative aspects of a measurement system being used together, however, these aspects can be implemented independently. In system 100, a cable 108 to the surface 106 provides electrical communication to a downhole sensor or actuator in a wellbore 102. In one example, cable 108 may be a cable (e.g. a tubing encapsulated cable (TEC) or other cable types used downhole used to transmit power and/or signals) that connects to multiple loads downhole. The cable 108 may connect to a surface instrument 115 or a computing device 116, or both. Either or both of the surface instrument or the computing device includes a processing device that is couplable to the cable 108 in the sense that the processing device can act on signals from or cause the generation of signals sent downhole. The cable 108 may connect to a downhole circuit 110. Examples of downhole circuit 110 include and actuator, a sensor and the circuitry to couple the actuator or sensor to the cable 108. The system may have multiple actuators or sensors included in or on a tool string 114. As a more specific example, the circuit 110 can include an inductive coupler with antennas to transfer information from sensors behind a well casing or otherwise not directly connected to the cable 108.

Figure 2:
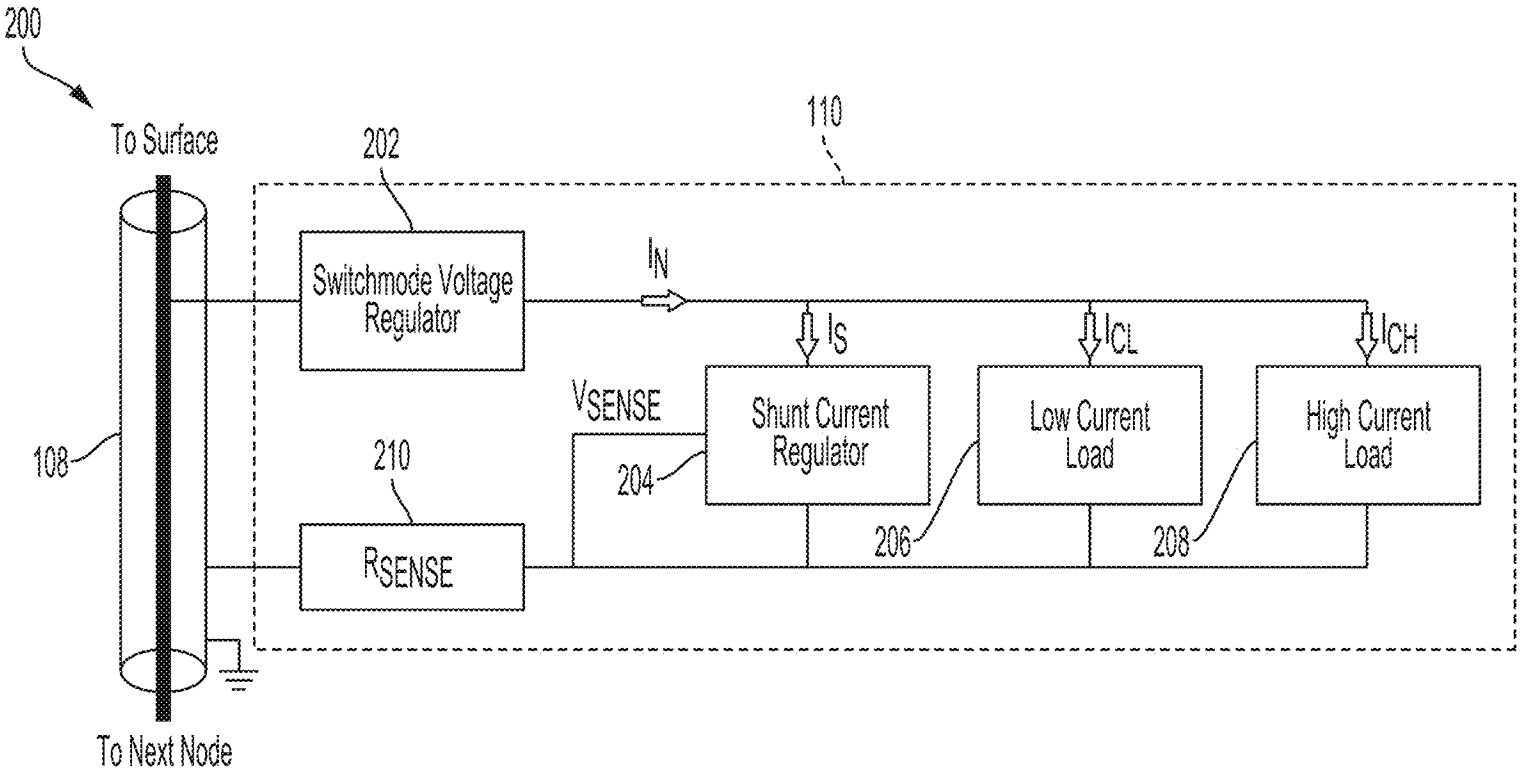
FIG. 2 is a block diagram of a downhole circuitry system according to some aspects of the disclosure.

FIG. 2 illustrates an example of a block diagram of a downhole circuit 110 connected to a cable 108, e.g. TEC or other shielded cable used in permanent completions systems. In one or more embodiments, the cable 108 is connected to a switch mode voltage regulator 202 that regulates the node current IN to a periodically or permanently constant value. An example of a switch mode voltage regulator 202 is a switched mode power supply that varies the duty cycle to regulate the output voltage. As depicted in FIG. 2, the switch mode voltage regulator 202 provides node current IN that splits to provide shunt current IS to a shunt current regulator 204, low-current load current $I_{CL}$ to a low-current load 206, and high-current load current $I_{CH}$, a high-current load 208. While FIG. 2 depicts the shunt current regulator 204, a low-current load 206, and a high-current load 208 in a parallel configuration, other configurations are possible. Examples of the low-current load 206 are electronic devices associated with the node (e.g., sensors, controllers, etc.). Examples of the high-current load 208 are actuators or inductive coupler loads. The shunt current regulator 204 regulates the current $I_S$ to keep $I_N$ substantially constant and slightly greater than the maximum combination of $I_{CL}$ and $I_{CH}$.

Still referring to FIG. 2, this configuration provides significant improvements for systems with a remote power source or a low quality power distribution medium such as the downhole configuration illustrated by FIG. 1. Particularly in a system that implements power line communication (PLC) over the cable 108, the use of a shunt current regulator improves the throughput and error rate of communication messages over the cable 108 by maintaining a stable current. In some examples, the current on the cable 108 is maintained approximately 100% stable with the use of the shunt current regulator. Accordingly, the communication messages over the cable 108 are not significantly impacted by downhole load current variation.

Figure 3:
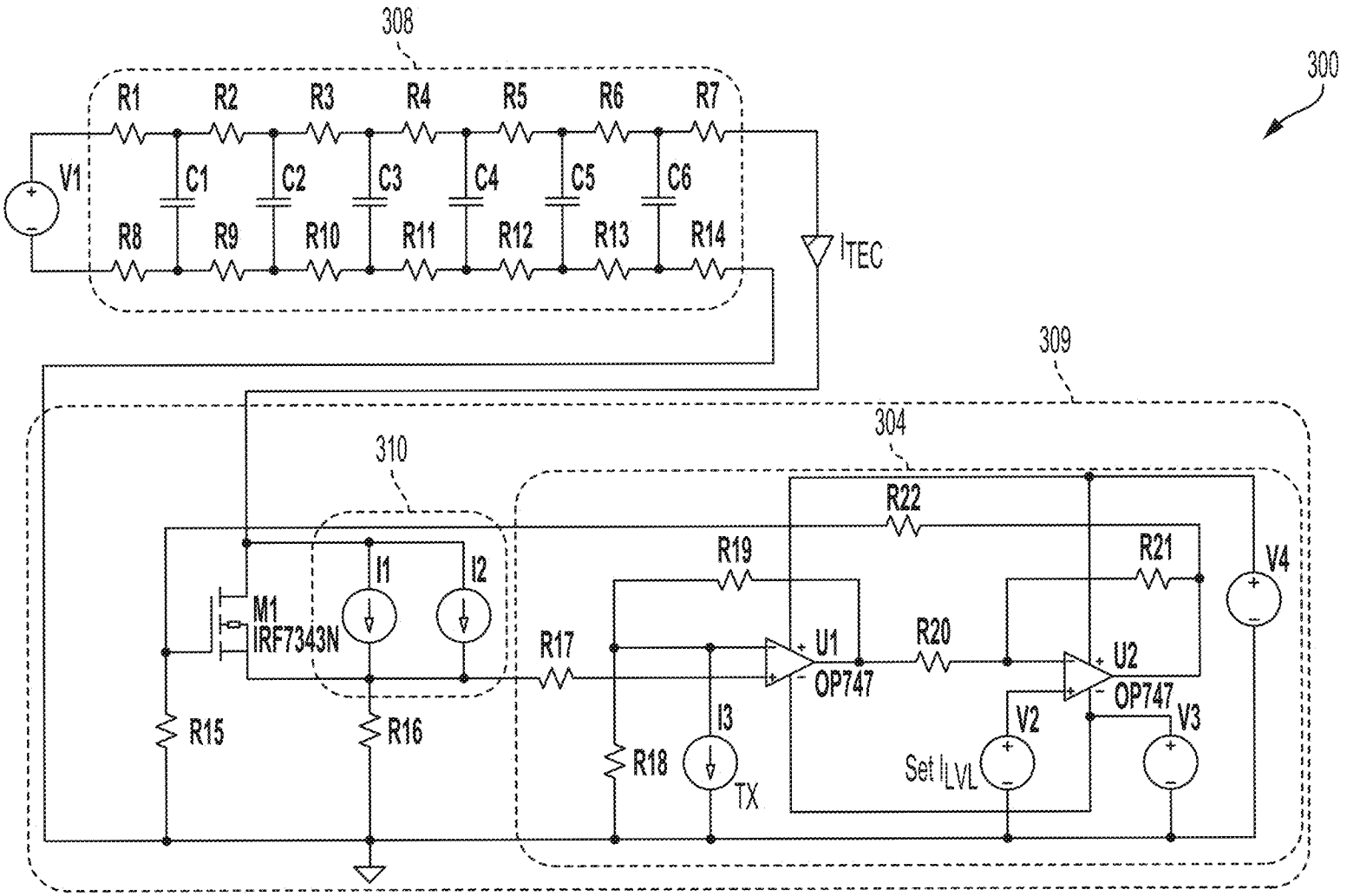
FIG. 3 is a circuit schematic of a downhole circuitry system for stabilizing the current to downhole devices according to certain aspects of the disclosure.

FIG. 3 depicts an example of a current stabilization circuit according to certain aspects of the disclosure. The shunt current regulator 304 maintains current on a cable 308 to be substantially stable during operation of a downhole device 309. Cable 308 may be tubing encapsulated cable (TEC) or other cable types used downhole used to transmit power and/or signals. The current drawn from the cable 308 is approximately constant. In this example, the shunt current regulator 304 monitors the current drawn by monitoring the voltage over a sensing element (e.g., a sensing resistive element like R16 or an active circuit) in the circuit 300. In the shunt current regulator 304, the voltage V2 defines the level of current to be drawn by the current load 310. In other configurations, voltage can be measured by a current mirror or Norton amplifier. The shunt current regulator 304 may include adaptive or automatic hardware. In other configurations, the shunt current regulator 304 may be dependent on a setting made via commands or software algorithms by a controller or computing system.

The shunt current regulator 304 may also facilitate sending and receiving communication messages via signals using PLC. For example, I3 of the circuit 300 may be a digital signal representing data to be transmitted from the downhole node to the surface. In this particular example, the communication message may be represented by fifteen square pulses. As depicted in FIG. 3, the circuit 300 may use a transistor M1 as a driver for the transmitter. In some examples, the transistor M1 may also handle the compensation current needed to fill in the dips in load current ($I_{TEC}$). The resulting current on the cable 308 ($I_{TEC}$) is relatively smooth. The smoother current reduces complexity of signal decoding of communication messages. The reduction in complexity may be due to a lower error rate because the digital communication signals are not affected by the downhole load current variations.

Still referring to FIG. 3, the implementation of a shunt current regulator 304 allows for the removal of capacitors in the circuit 300 while maintaining the stability of the current on the cable 308. Accordingly, the absence of capacitors improves signal quality by removing the capacitive effects that cause signal attenuation and noise. The shunt current regulator 304 also limits the effects of the current fluctuation of the downhole loads. Capacitors have the disadvantage of being unreliable at high temperatures. Depending on the design, the capacitors may also attenuate the communication signal when signaling on the same cable as the power is transferred. Accordingly, a circuit that reduces the current variation while eliminating the need for capacitors is advantageous. The potential reliability issues with capacitors are also eliminated.

In the example depicted in FIG. 3, amplifier U1 may be a first amplifier that amplifies a sense signal as measured across the sensing element (depicted here as a sensing resistive element, R16). Amplifier U2 may be a second amplifier that generates a correction signal driving the transistor M1 that maintains current in the cable 308, $I_{TEC}$, approximately constant as defined by the constant voltage V2. In one aspect, allowing simultaneous powering of multiple inductive couplers and other instruments on the network, polling commands can be transmitted to any instrument on the cable 308 or behind inductive couplers. In another aspect, broadcast messages or high-speed sequential polling can make the polling efficient. Multiple instruments may work in parallel since the network is stable. Each instrument on the network may generate data that can be stored temporarily in the node circuitry, including a shunt current regulator 304, a noise canceller, or by the instrument itself.

In one aspect, the difference between the instantaneous current requirement and the set constant current level may be passed through the transistor (e.g., transistor M1) working in its linear operating mode, meaning that power will be dissipated in the transistor. In the circuit 300 depicted in FIG. 3, I1 represents the current through an inductive coupler coil driven by two half-bridges. Each half-bridge may drive the inductive coupler coil approximately 50% of the time and accordingly operate primarily in non-linear mode, either on or off, which reduces the power dissipation in the transistor. In this case, the transistor (M1 in the circuit 300) may be in its linear mode of operation for relatively short periods of time right after switching from one half-bridge to the other. The transistor may still dissipate more power than a coil driving transistors.

In some examples, the power dissipated in the transistor (i.e., M1) enters an excessive condition and the transistor is unable to handle the power dissipation due to temperature conditions or transistor current dimensioning. In this case, the shunt current regulator 304 may allow some current fluctuations on the cable 308. During the current fluctuations on the cable 308, high-speed communication may not be available. The noise level can still be reduced by aspects of the disclosure by removing the steepest edges of the current variation transitions. The reduction of noise by removing the steepest edges of the current variation transitions still achieves improvements in decoding communication messages even at electrical limits of the downhole devices.

Still referring to FIG. 3, in one or more embodiments, the data from each instrument can be read from the surface over the cable 308 at high-speed from multiple instruments as soon as data is generated. In spite of particular instruments performing at different rates and the latency of data rates over inductive couplers, collecting data from a network of multiple instruments may still be improved because the instruments on the network may work simultaneously. In some configurations, group polling to groups of instruments or fast polling without waiting for reply can be done to further improve data collection rates from the surface controller or computing device.

In some examples, the shunt current regulator 304 or noise canceller may be set in accordance with any of three operating modes when the current exceeds the set stable current level. In a first mode, the shunt current regulator 304 may increase the fixed current level to account for the change in required current. In a second mode, the shunt current regulator 304 may allow excessive current to be drawn from the cable 308 without adjusting the preset fixed current level. In a third mode, the shunt current regulator 304 may limit the current to the set level (causing a drop in supply voltage to an instrument). The shunt current regulator 304 can select any of these three modes responsive to commands from the surface. In some cases, the shunt current regulator 304 may include a protection feature that may automatically change operating mode based on transistor temperature or other physical properties. The shunt current regulator 304 may change the operating mode to protect the electronics from destruction or degradation. The shunt current regulator 304 may implement the protection feature in hardware or as firmware monitoring the health of critical components.

FIG. 3 illustrates other electronic components in some aspects of the circuit 300. The cable 308 may have various resistive elements connected in series or parallel with capacitive elements, examples of these elements are resistors R1-R14 and capacitors C1-C6 as illustrated in FIG. 3. The cable 308 may also have inductive elements not shown in FIG. 3, however, it will be appreciated that cable 308 may represent a simplified equivalent circuit for many cable configurations (e.g., any type of cable). The shunt current regulator 304 may have various circuit components including resistors R17-R22, voltage sources V2-V4, and current source 13. The current load 310 may include current sources I1 and 12 and be coupled to resistors R16 (i.e., a sensing element) and transistor M1.

Figure 4:
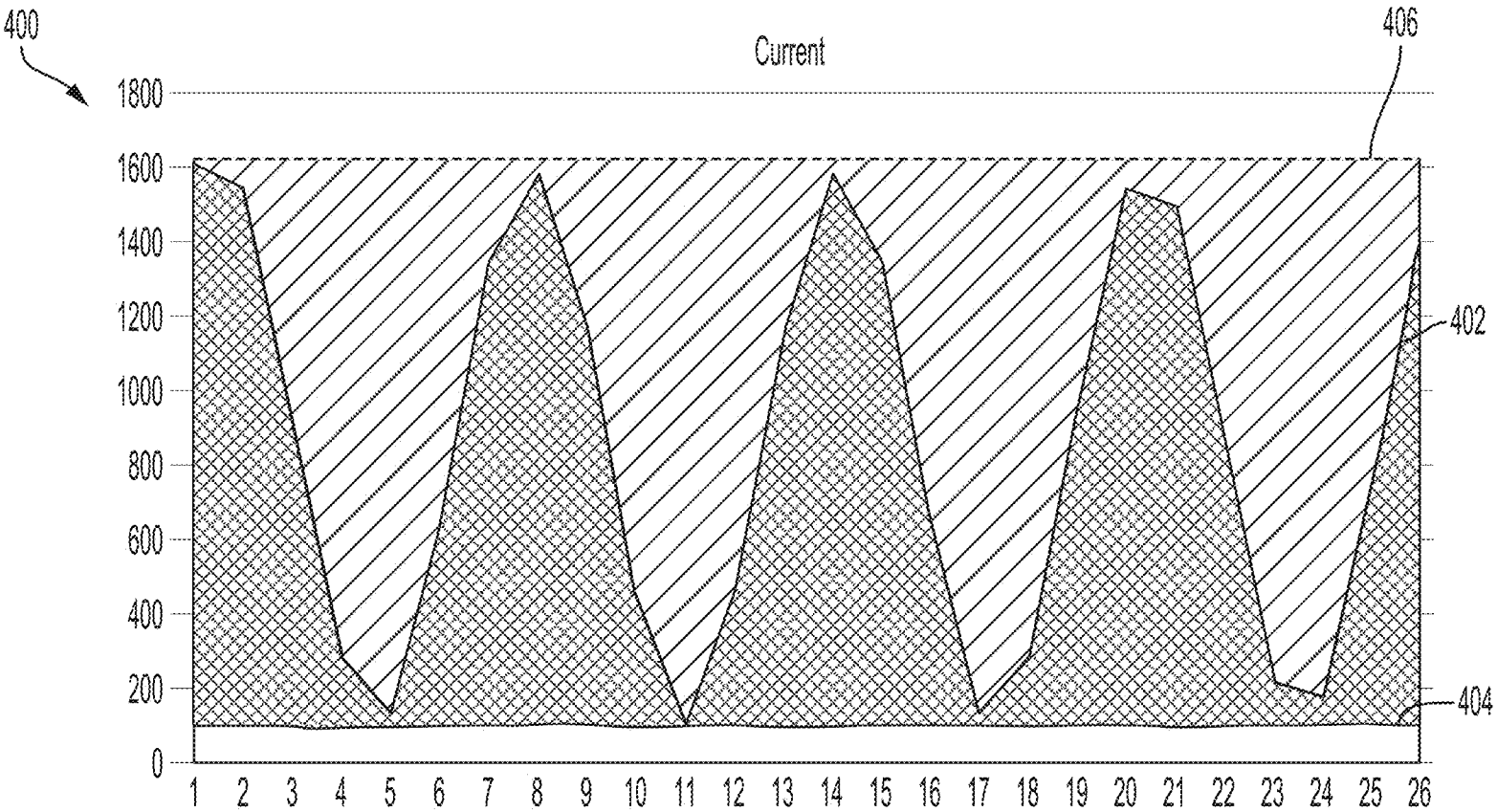
FIG. 4 depicts a plot of the current levels within a downhole circuit of a downhole node according to some aspect of the disclosure.

FIG. 4 depicts a plot 400 of the current levels within a downhole circuit of a downhole node according to some aspect of the disclosure. In one example, the plot of the current levels depicted in FIG. 4 may be measured in a downhole circuit, such as the downhole circuit depicted in FIG. 2. As illustrated by FIG. 4, a switch mode voltage regulator (i.e., switch mode regulator 202 in FIG. 2) provides node current $I_N$ 406 (i.e., the hashed line) that is split by parallel circuit components. In one or more embodiments, the shunt current varies to maintain IN substantially constant and slightly greater than the maximum combination of $I_{CL}$ and $I_{CH}$, as illustrated by line 402. The area below line 402 roughly represents the variable load current and the area above line 402 represents the varying shunt current. The low-current load current $I_{CL}$ represented by line 404 may be provided to electronic components of the downhole circuit, such as measuring sensors and controllers. Accordingly, the current of the low-current load $I_{CL}$ is substantially constant. The high-current load $I_{CH}$ current may be an actuator and accordingly is characterized by a substantial variation in peak and valleys of the current waveform $I_{CH}$. An example of the current $I_{CH}$ peak may be activation of the actuator at a maximum current draw, while the valley of the current $I_{CH}$ may indicate a deactivation of the actuator at a minimum current draw.

Approximately constant current level represented by line 404 represents the current drawn by electronics associated with the downhole device. The shunt current regulator may set the constant current level $I_{TEC}$ based on computing a long-term historic current requirement average, adjusting a moving average over a certain period of time, or adjusting according to a previous or future operating mode of the shunt current regulator. The constant current level, represented by line 406 in FIG. 4 (e.g., ITEC in FIG. 3) may be adjusted up or down at a configurable rate, for example, a rate that is set to minimize disturbance of the cable communication.

Figure 5A:
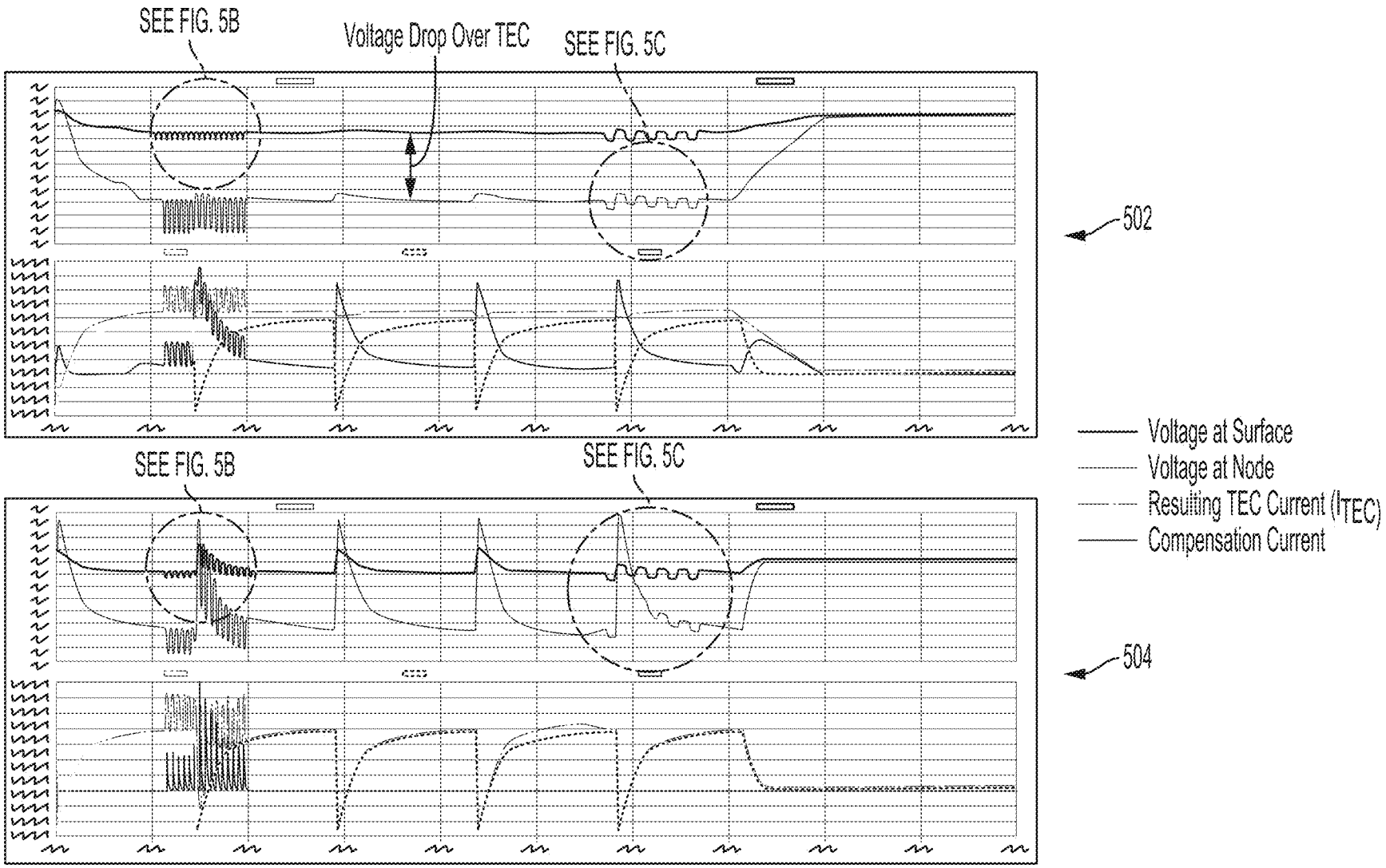
FIG. 5A depicts two diagrams of voltage and current measurements in two different circuits according to some aspect of the disclosure.

FIG. 5A depicts two diagrams of voltage and current measurements in two different circuits according to some aspect of the disclosure. For purposes of explanation, the circuit 300 of FIG. 3 provides circuit output data 502 and may be assumed to implement some aspect of the disclosure, while a circuit that does not implement a shunt current regulator as described herein in some aspects is represented by circuit output data 504. In circuit output data 504, the constant current level represented by line 404 (i.e., $I_{TEC}$ current) has two components. In one example, $I_{TE}$ is the combination of I1 and 12 as referenced in circuit 300 of FIG. 3 but without shunt current regulator 304. For instance, I1 may represent the current drawn by an inductive coupler unit and I2 may represent an additional current for electronics supply or for communication signals carried over the inductive coupler as a signal modulated on the power in the inductive coupler. The combination (e.g., a sum) of the two components I1 and I2 results in $I_{TE}$. In some cases, communications can be transmitted as one or more series of pulses. Comparing the communication from the node of the circuit that has circuit output data 502 with the communication from the node of the circuit that has circuit output data 504, the example in FIG. 5A clearly depicts that the communication voltage waveform from the circuit corresponding to output data 502 evidences significantly more stability than the communication voltage waveform from circuit output data 504. Accordingly, decoding the transmitted communication from the circuit that has circuit output data 502 is significantly less difficult than decoding the transmitted communication from the circuit that has circuit output data 504.

Figure 5B:
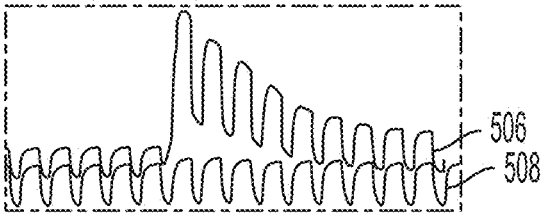
FIG. 5B depicts communications from a downhole circuit to a surface computing device in two different circuits according to some aspect of the disclosure.

FIG. 5B depicts communications from a downhole circuit to a surface computing device in two different circuits according to some aspect of the disclosure. For example, FIG. 5B illustrates a communication 508 from a downhole circuit with a shunt current regulator to a surface computing device as compared with a communication 506 from a downhole circuit that does not implement the shunt current regulator to a surface computing device. In the particular example of FIG. 5C, the communication is measured at the surface computing device.

Figure 5C:
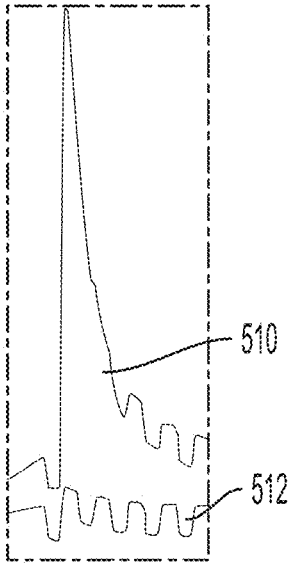
FIG. 5C depicts communications from a surface computing device to a downhole circuit in two different circuits according to some aspect of the disclosure.

FIG. 5C depicts communications from a surface computing device to a downhole circuit in two different circuits according to some aspect of the disclosure. For example, FIG. 5C illustrates a communication 512 from a surface computing device to a downhole circuit with a shunt current regulator as compared with communication 510 from a surface computing device to a downhole circuit that does not implement the shunt current regulator. In the particular example of FIG. 5C, the communication is measured at the downhole circuit.

Referring to FIGS. 5A-5C, in downhole applications, implementation with minimal, sensitive components is crucial for reliability. Less noise on the communication channel may allow for increased bitrates and communication with relatively straightforward transmitter and receiver circuits. Inductive coupler communication is generally slow compared to other traffic on the cable line. Accordingly, if the inductive couplers in the system occupy a substantial quantity of time for powering or communication, or both, overall system performance may be reduced significantly. Some aspects of the disclosure enable communication at a higher bitrate. In addition, aspects of the disclosure enable communication with other instruments while waiting for data from one or many other active (e.g., creating current noise downhole) downhole instruments. Incorporating local data storage and high-speed readout on request when data is available will further improve the response time of the overall system.

In an example of communication timing improvements, the following non-limiting example is provided. In one example of a system, two downhole instruments each located in circuits behind four inductive couplers (i.e., a total of 8 inductive couplers) and an additional 15 instruments are connected directly to the cable line (i.e., 23 cable line connections total).

For explanatory purposes, the response times in the system may be a one-second response time from each instrument directly connected to the cable line and two seconds from each instrument located in circuits behind inductive couplers. Using these examples of values, the communication time for the instruments can generally be computed as four seconds for the two instruments multiplied by the number of inductive couplers yielding a total of 16 seconds. The additional 15 instruments would add 15 seconds (i.e., one second each) to the total response time. Accordingly, the total response time in this example is 31 seconds. Implementing some aspects of the disclosure and including local storage capabilities, the total response time can be reduced to four seconds.

The additional 15 instruments on the cable line can be polled simultaneously in a group that may include the additional 15 instruments. The simultaneous polling of the additional instruments can take place while waiting for the instruments behind the inductive couplers to get ready. In this example, at a time when the slowest instrument behind the inductive coupler is ready to communicate (e.g., after about 4 seconds), all the other instruments have already been polled and data has been read at relatively high-speed on the cable. The communication improvement is approximately eight-fold by receiving the instrument data from 23 instruments in four seconds compared with a typical speed of receiving the instrument data from 23 instruments in 31 seconds.

Figure 6:
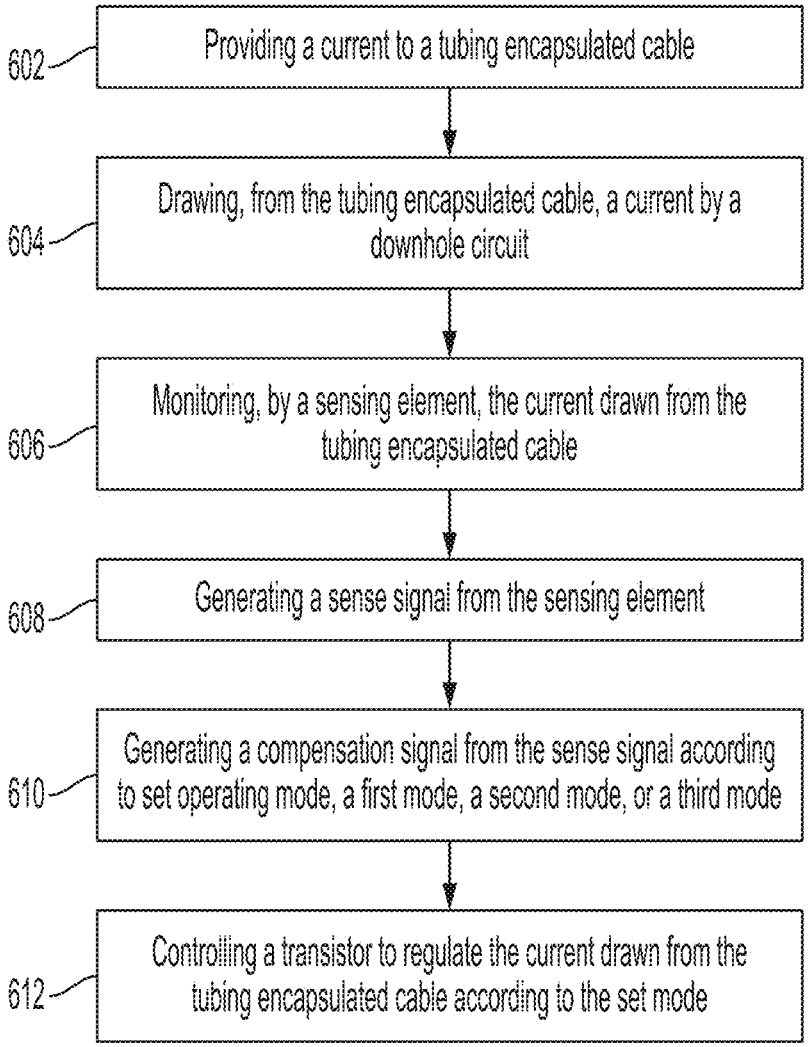
FIG. 6 is a flowchart of a process for regulating current drawn from a tubing encapsulated cable according to some aspects of the disclosure.

FIG. 6 is a flowchart of a process for regulating current drawn from a tubing encapsulated cable according to some aspects of the disclosure. Process 600 as illustrated in FIG. 6 provides a method of controlling a transistor to regulate current drawn from the cable. At block 602, the system provides a current to a cable. At block 604, the downhole circuit (e.g., downhole circuit 110) draws a current from the cable. At block 606, the current drawn from the cable is monitored by a sensing element. For instance, a sensing element (e.g., R16 of FIG. 3) monitors the voltage and determines the current level on the cable. At block 608, the sensing element generates a sense signal. For instance, a sense signal may be generated by measuring the voltage across the sensing element (i.e., R16). In some cases, the sense signal may be amplified by amplifier U1. At block 610, a compensation signal is generated from the sense signal to control current according to the selected one of the operating modes. For instance, a compensation signal may be generated by transistor M1 of FIG. 3. In one example, the transistor M1 may provide compensation current to fill a dip in load current to maintain the current level in the cable stable. At block 612, a transistor is controlled to regulate the current drawn from the cable according to the set operating mode as described with regards to FIGS. 1-5.

Terminology used herein is for describing particular embodiments only and is not intended to be limiting. As used herein, the singular forms "a," "an," and "the" are intended to include the plural forms as well, unless the context clearly indicates otherwise. It will be further understood that the terms "comprises" or "comprising," when used in this specification, specify the presence of stated features, steps, operations, elements, or components, but do not preclude the presence or addition of one or more other features, steps, operations, elements, components, or groups thereof. Additionally, comparative, quantitative terms such as "above," "beneath," "less," and "greater" are intended to encompass the concept of equality, thus, "less" can mean not only "less" in the strictest mathematical sense, but also, "less than or equal to." Use of terms such as "first" and "second" when describing components is for convenience of description only, and does not imply a location, order of operation, or order of assembly.

The order of the process blocks presented in the examples above can be varied, for example, blocks can be re-ordered, combined, or broken into sub-blocks. Certain blocks or processes can be performed in parallel. The use of "configured to" herein is meant as open and inclusive language that does not foreclose devices configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Elements that are described as "connected," "connectable," or with similar terms can be connected directly or through intervening elements.

In some aspects, a system for regulating current is provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is an apparatus comprising: a voltage regulator couplable to a cable extending downhole from a surface through a wellbore; and a shunt current regulator communicatively coupled to the voltage regulator, the shunt current regulator including a sensing element to monitor a current drawn from the cable downhole, wherein the shunt current regulator is couplable to a current load.

Example 2 is the apparatus of examples 1, wherein the current load comprises a high-current load connected to the switch mode voltage regulator.

Example 3 is the apparatus of example 1, wherein the current load comprises a high-current load and a low-current load coupled in parallel.

Example 4 is the apparatus of examples 1-3, further comprising a computing device to receive a communication from the current load via the cable.

Example 5 is the apparatus of examples 1-3, wherein the sensing element comprises a current sensing resistive element to produce a voltage monitored by the shunt current regulator.

Example 6 is the apparatus of examples 1-3, further comprising a transistor communicatively coupled to the sensing element, wherein a sense signal from the sensing element is configurable to provide a compensation signal that is applied to the transistor to control the transistor to regulate the current drawn from the tubing encapsulated cable downhole.

Example 7 is the apparatus of example 6, further comprising: a first amplifier connected to the sensing element to amplify the sense signal, wherein the sense signal comprises a voltage across the sensing element; and a second amplifier connected to the transistor to amplify a correction signal to produce the compensation signal.

Example 8 is a method of current regulation, the method comprising: monitoring, by a sensing element, a current drawn from a tubing encapsulated cable disposed downhole extending downhole from a surface through a wellbore; generating a sense signal from the sensing element; generating a compensation signal from the sense signal; and controlling a transistor to regulate the current drawn from the tubing encapsulated cable, wherein the controlling comprises: dissipating power in the transistor to stabilize the current drawn; and providing compensation current to increase the current drawn.

Example 9 is the method of current regulation of example 8, wherein the sensing element comprises a current sensing resistive element connected between the tubing encapsulated cable and a shunt current regulator.

Example 10 is the method of current regulation of example 8, further comprising setting a substantially constant current level, the setting comprising at least one of: a first mode that increases the substantially constant current level to meet a current draw demand; a second mode that allows an excessive current to be drawn from the tubing encapsulated cable preserving the substantially constant current level; or a third mode that limits the current to the substantially constant current level.

Example 11 is the method of current regulation of example 10, further comprising transitioning between modes automatically based on a temperature of the transistor or other physical properties of the transistor.

Example 12 is a system comprising: a processing device couplable to a tubing encapsulated cable extending downhole from a surface through a wellbore, wherein the processing device is operable to: decode communication from a downhole node; and send communication to the downhole node; the downhole node comprising: a switch mode voltage regulator couplable to the tubing encapsulated cable; a shunt current regulator couplable to the switch mode voltage regulator, the shunt current regulator including a sensing element to monitor a current drawn from the tubing encapsulated cable downhole; and a current load.

13. The system of example(s) 12, wherein the current load comprises a high-current load and a low-current load connected in parallel.

Example 14 is the system of example 12, wherein the downhole node further comprises a current sensing active circuit connected between the tubing encapsulated cable and the shunt current regulator.

Example 15 is the system of example 12, wherein the sensing element comprises a current sensing active circuit, wherein the current sensing active circuit produces a voltage monitored by the shunt current regulator.

Example 16 is the system of example 12, comprising a transistor communicatively coupled to the sensing element, wherein a sense signal from the sensing element provides a compensation signal that is applied to the transistor to control the transistor to regulate the current drawn from the tubing encapsulated cable.

Example 17 is the system of examples 12-16, further comprising: a first amplifier connected to the sensing element to amplify the sense signal, wherein the sense signal comprises a voltage across the sensing element; and a second amplifier connected to the transistor to amplify a correction signal to produce the compensation signal.

Example 18 is the system of examples 12-16, further comprising an inductive coupler connected to the downhole node.

Example 19 is the system of examples 12-16, wherein at least one of the communication from the downhole node or the communication to the downhole node comprises power line communication over the tubing encapsulated cable.

Example 20 is the system of examples 12-16, wherein the shunt current regulator sets the current drawn from the tubing encapsulated cable in accordance with at least one of: a first mode that increases a substantially constant current level to meet a current draw demand; a second mode that allows an excessive current to be drawn from the tubing encapsulated cable preserving the substantially constant current level; or a third mode that limits the current to the substantially constant current level.

The foregoing description of the examples, including illustrated examples, has been presented only for the purpose of illustration and description and is not intended to be exhaustive or to limit the subject matter to the precise forms disclosed. Numerous modifications, combinations, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. An apparatus comprising:

a voltage regulator couplable to a tubing encapsulated cable extending downhole from a surface through a wellbore; and a shunt current regulator to maintain a stable cable current communicatively coupled to the voltage regulator, the shunt current regulator including a sensing element to monitor a current drawn from the tubing encapsulated cable extending downhole, wherein the shunt current regulator is couplable to a current load.

2. The apparatus of claim 1, wherein the current load comprises a high-current load connected to the voltage regulator.

3. The apparatus of claim 1, wherein the current load comprises a high-current load and a low-current load coupled in parallel.

4. The apparatus of claim 1, further comprising a computing device to receive a communication from the current load via the tubing encapsulated cable extending downhole.

5. The apparatus of claim 1, wherein the sensing element comprises a current sensing resistive element to produce a voltage monitored by the shunt current regulator.

6. The apparatus of claim 1, further comprising a transistor communicatively coupled to the sensing element, wherein a sense signal from the sensing element is configurable to provide a compensation signal that is applied to the transistor to control the transistor to regulate the current drawn from the tubing encapsulated cable extending downhole.

7. The apparatus of claim 6, further comprising:

a first amplifier connected to the sensing element to amplify the sense signal, wherein the sense signal comprises a voltage across the sensing element; and a second amplifier connected to the transistor to amplify a correction signal to produce the compensation signal.

8. A method of current regulation, the method comprising:

monitoring, by a sensing element, a current drawn from a tubing encapsulated cable extending downhole from a surface through a wellbore;

generating a sense signal from the sensing element;

generating a compensation signal from the sense signal; and controlling a transistor to regulate the current drawn from the tubing encapsulated cable extending downhole, wherein the controlling comprises:

dissipating power in the transistor to stabilize the current drawn; and providing compensation current to increase the current drawn.

9. The method of current regulation of claim 8, wherein the sensing element comprises a current sensing resistive element connected between the tubing encapsulated cable and a shunt current regulator.

10. The method of current regulation of claim 8, further comprising setting a substantially constant current level, the setting comprising at least one of:

a first mode that increases the substantially constant current level to meet a current draw demand;

a second mode that allows an excessive current to be drawn from the tubing encapsulated cable preserving the substantially constant current level; or a third mode that limits the current to the substantially constant current level.

11. The method of current regulation of claim 10, further comprising transitioning between modes automatically based on a temperature of the transistor or other physical properties of the transistor.

12. A system comprising:

a processing device couplable to a tubing encapsulated cable extending downhole from a surface through a wellbore, wherein the processing device is operable to:

decode communication from a downhole node; and send communication to the downhole node;

the downhole node comprising:

a switch mode voltage regulator couplable to the tubing encapsulated cable;

a shunt current regulator to maintain a stable cable current couplable to the switch mode voltage regulator, the shunt current regulator including a sensing element to monitor a current drawn from the tubing encapsulated cable extending downhole; and a current load.

13. The system of claim 12, wherein the current load comprises a high-current load and a low-current load connected in parallel.

14. The system of claim 12, wherein the downhole node further comprises a current sensing active circuit connected between the tubing encapsulated cable and the shunt current regulator.

15. The system of claim 12, wherein the sensing element comprises a current sensing active circuit, wherein the current sensing active circuit produces a voltage monitored by the shunt current regulator.

16. The system of claim 12, comprising a transistor communicatively coupled to the sensing element, wherein a sense signal from the sensing element provides a compensation signal that is applied to the transistor to control the transistor to regulate the current drawn from the tubing encapsulated cable.

17. The system of claim 16, further comprising:

a first amplifier connected to the sensing element to amplify the sense signal, wherein the sense signal comprises a voltage across the sensing element; and a second amplifier connected to the transistor to amplify a correction signal to produce the compensation signal.

18. The system of claim 12, further comprising an inductive coupler connected to the downhole node.

19. The system of claim 12, wherein at least one of the communication from the downhole node or the communication to the downhole node comprises power line communication over the tubing encapsulated cable.

20. The system of claim 12, wherein the shunt current regulator sets the current drawn from the tubing encapsulated cable in accordance with at least one of:

a first mode that increases a substantially constant current level to meet a current draw demand;

a second mode that allows an excessive current to be drawn from the tubing encapsulated cable preserving the substantially constant current level; or a third mode that limits the current to the substantially constant current level.

* * * * *